United States Patent [19]

Roberts

[11] 4,151,681

[45] May 1, 1979

[54] ARRANGEMENT FOR MOUNTING HINGE PIN SOCKETS TO CABINET DOORS

[75] Inventor: Edward H. Roberts, Jeffersontown, Ky.

[73] Assignee: General Electric Company, Louisville, Ky.

[21] Appl. No.: 856,372

[22] Filed: Dec. 1, 1977

[51] Int. Cl.[2] ..... E05D 7/02

[52] U.S. Cl. ..... 49/382; 49/501; 85/45; 151/41.75; 308/238; 312/138 R

[58] Field of Search ..... 49/382, 501, 388, 193; 312/326, 214, 138 R; 308/238; 85/36, 45, 41; 151/41.75; 16/169, 191, 171

[56] References Cited

U.S. PATENT DOCUMENTS

| | | | |
|---|---|---|---|
| 1,260,154 | 3/1918 | Day | 85/41 |
| 2,171,773 | 9/1939 | Von Mertens | 85/36 |
| 2,326,261 | 8/1943 | Shippee et al. | 85/36 |
| 2,704,357 | 3/1955 | Johnson | 85/DIG. 2 |
| 2,866,675 | 12/1958 | Kesling | 312/214 |
| 3,065,035 | 11/1962 | Biesecker | 308/238 X |
| 3,290,109 | 12/1966 | Vanegas | 85/86 X |
| 3,364,807 | 1/1968 | Holton | 85/36 |
| 3,430,386 | 3/1969 | Sandin et al. | 49/193 |
| 3,448,650 | 6/1969 | Whitehouse | 85/36 |
| 3,910,156 | 10/1975 | Soltysik | 85/36 |

*Primary Examiner*—Philip C. Kannan
*Attorney, Agent, or Firm*—Frederick P. Weidner; Radford M. Reams

[57] ABSTRACT

An arrangement for mounting hinge pin sockets within cabinet doors, particularly adaptable to reversible door refrigerators, including an anchor plate frictionally secured within each door corner, and formed with a hole pattern for receiving threaded fasteners used to mount the cabinet door handles and the door stop with a common hole location allowing a reverse assembly of the door handle and the door stop on either side of the cabinet door. The anchor plates serve to mount a hinge pin socket at each corner of the door, the sockets extending into opposed lateral sides of the cabinet door in corresponding location to reversibly mounted hinge pin assemblies secured to the cabinet. The hinge pin sockets are mounted to the anchor plates by a thread mount comprised of an external thread formed on each hinge pin socket engaging a pair of threading strips formed on each anchor plate, the threading strips extending radially inward with an intermediate space therebetween aligned with clearance bores in the door edge and the anchor plate. The hinge pin sockets are driven at assembly into the anchor plates by a tool drive recess formed at one end of the hinge pin receiving bore in each of the hinge pin sockets.

29 Claims, 10 Drawing Figures

FIG. 1
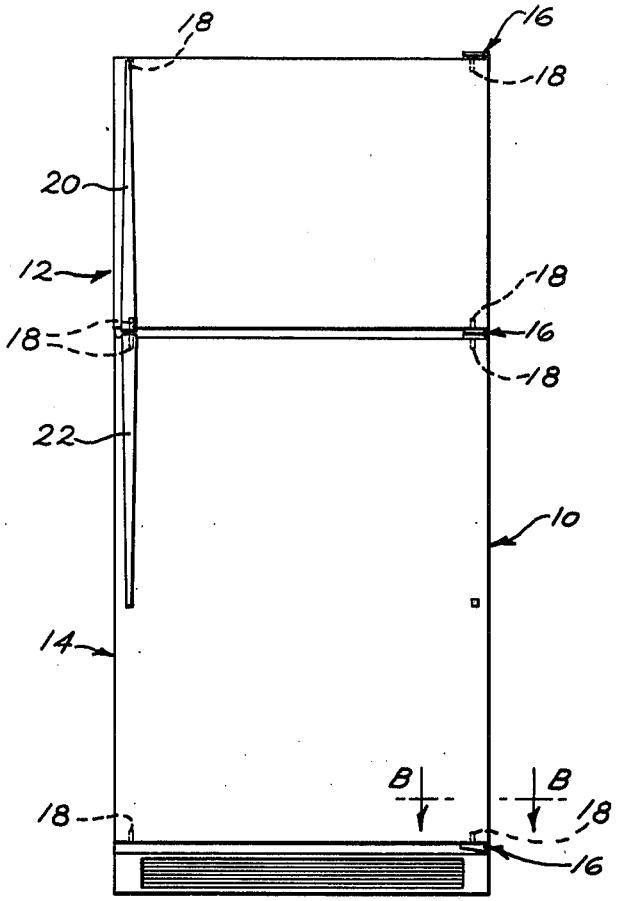
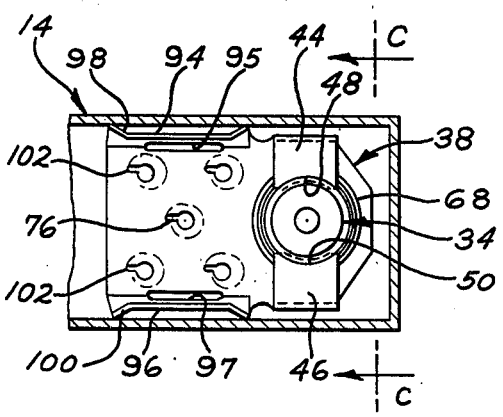
FIG. 4
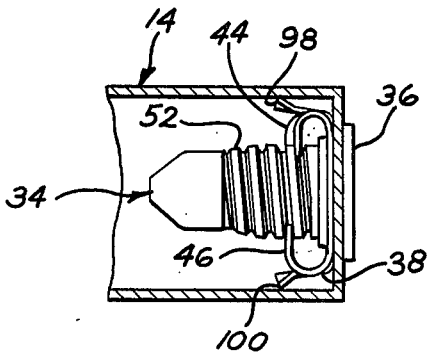
FIG. 5
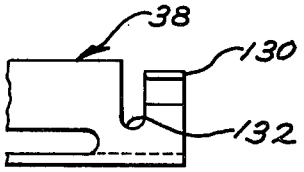
FIG. 9
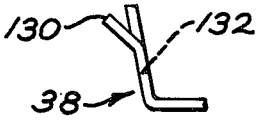
FIG. 10

ARRANGEMENT FOR MOUNTING HINGE PIN SOCKETS TO CABINET DOORS

BACKGROUND OF THE INVENTION

1. Field of the Invention

This invention concerns cabinet structures and more particularly mounting hardware for reversible refrigerator doors.

2. Background Discussion

It is common practice in the mounting of formed cabinet doors to utilize a socket or bushing element mounted within the interior space of the cabinet door to receive and provide pivotal support for the hinge pins which are secured to the cabinet. This is particularly true in refrigerator cabinetry since the doors are constructed of sheet steel, formed into a door by forming the edges of the outer panel with rearwardly extending flanges comprising the door lateral edges and reentrant flanges to which is secured the inner liner panel of the door.

The interior space so formed is filled with insulating material.

Thus, the door structure consists of a relatively thin gauge sheet metal, not of adequate strength to provide support for the hinge pins by merely forming pin receiving openings in the door edges.

There have been various design approaches which involve mounting hinge pin sockets within the interior of the door, these sockets comprised of sleeves having hinge pin receiving bores. One method is to utilize sockets formed of steel and weld the sockets to the interior surface of the lateral edges, over suitably located clearance openings in the door edge. While a welded joint would normally provide a high strength securement of the socket to the door edge, under production conditions it is not always possible to assure complete reliability of the welds produced such that occasional failures are encountered.

In addition, the welding of the hinge pin socket to the door edge is usually done before surface treatment, i.e., bonderizing, etc. of the formed door. Such surface treatments generally involve aqueous solutions which must be thoroughly drained from the door to insure complete drying prior to painting. The opening in the door edge receiving the hinge pin provides a convenient, adequately sized drain hole if it were possible for the hole to remain clear until after this production stage has been reached. Since the welding process is necessary before such surface treatment, a special drain hole must be cut into the door edge since the solutions tend to be impounded by the flanges. Such opening must then be resealed, hence increasing the manufacturing costs involved.

Another approach which has been utilized involves the swaging of an opening into the door edge, into which is pressed a plastic or steel socket in order to obtain adequate support for the hinge pin. It can be appreciated that the swaged lip about the opening would preclude its use as the drain hole, as does the welding method referred to above.

In addition, it has been the experience with this approach that the sockets have a tendency to be loosened after extensive use since the opening and closing of the door to the full stop position exerts a loosening force on the socket.

Yet another approach has involved the use of a "square hole" engagement with a plastic hinge pin socket in which a specially shaped hole is formed in the door panel and a recess formed in the plastic socket engages the square hole to lock to the lateral edge of the hole. This approach may not provide adequate strength to prevent loosening of the socket since only the thickness of the sheet metal is available to support the socket pin. Another drawback results from the hinge pin socket being provided with tool receiving splines which represent a discontinuity creating a stress point which further contributes to the incidence of failure of these elements. The size and position of the square hole is also critical such that the forming of the door could not take place prior to punching of the hole, and thus, the hole had to be formed after the door was formed, a more difficult manufacturing step. The close tolerance of the square hole itself requires post piercing rather than a simple punch operation.

The strength of the hinge pin socket is important in the design of these units since good design practice dictates that if the door is opened to the full stop position with sufficient force to create a failure, this failure preferably occurs in the door stop rather than in the door panel or hinge construction such that the door may still be opened and closed. Accordingly, the hinge pin socket and mounting which absorbs the hinge pin load should be of relatively high strength. Many of the door mount designs have not been of adequate strength to prevent hinge pin failures, contrary to this desired design goal.

This was due to splitting of the hinge pin sockets under pressure by the hinge pins, particularly a problem where a tool driving recess is located so as to be loaded by the hinge pin when the door stop is engaged as described above.

In connection with the installation of hinge pin sockets, the installation force which may be applied is often fairly limited, particularly since such sockets are advantageously made of molded plastic so as to be low in cost and provide friction-free pivoting of the hinge pins. It is difficult to combine tight secure mounting while keeping installation forces at modest levels within the limits of the strength of available plastic materials.

It is common practice to provide for reversibility of the doors of refrigerator cabinetry. That is, that the door handles and hinge hardware may be positioned from side to side on the door such that the door opening and closing can take place from either side of the refrigerator to adapt the refrigerator to convenient access at different locations. Such reversibility requires mounting hardware for the door handle at each corner since the door handle must be able to be removed and reinstalled at either side of the door. In addition, the lower corners of each door must be provided with the mounting hardware of the door stop. This mounting hardware generally comprises mounting plates or fasteners which are secured and retained within the interior space of the door on the lateral edges such that one can merely remove the screws securing the door handle and door stop to the door and reinstall them at opposite locations.

It would of course be advantageous if the mounting hardware for both the hinge pin sockets and the door handle and door stop could be combined in a single hardware item.

Accordingly, it is an object of the present invention to provide an arrangement for mounting hinge pin sockets within cabinet doors which affords a relatively high strength mounting.

It is another object of the present invention to provide an arrangement for mounting the hinge pin socket which does not require a welding operation and which leaves the hinge pin socket clearance opening clear in the door edges such that it may be utilized as a drain hole for surface treatment liquids prior to installation of the hinge pin sockets.

It is yet another object of the present invention to provide such a mounting arrangement in which the socket is securely retained without any tendency to become loosened but which may be installed with the application of relatively modest forces, such that molded plastic sockets may be utilized.

It is still a further object of the present invention to provide an arrangement utilizing a single hardware item to which is mounted the door handle, door stop and hinge pin sockets.

It is another object of the present invention to provide a mounting arrangement for articles such as the hinge pin sockets for securing such articles with a relatively low driving force while creating a nonloosening secure mount.

SUMMARY OF THE INVENTION

These and other objects, which will become apparent upon a reading of the following specification and claims, are accomplished by an arrangement including a plurality of anchor plates, one of which is adapted to be frictionally assembled into the interior of the door at each corner, each anchor plate formed with a hole pattern receiving threaded fasteners mounting the door handle or door stops. Integral with each anchor plate is a thread mount aligned with a clearance opening in the door edge into which is received the hinge pin socket threadably engaged with the thread mount. The thread mount comprises a pair of opposed threading strips positioned above a clearance opening formed in each of the anchor plates which have portions which are inwardly directed and adapted to mate with an exterior thread formed on each of the hinge pin sockets. Each of the threading strips have portions angled with respect to each other to allow the strips to be spread apart by a tapering of the external thread root to increase the frictional engagement forces, which are further increased upon seating of a flange formed on each hinge pin socket on the outside of the door edge adjacent the clearance opening. The outer ends of the portions of the threading strips engage the thread root and have an arcuate contour concentric with the full root diameter. Each hinge pin socket is formed with an interior bore adapted to mate with a cabinet hinge pin, with a terminal portion thereof formed with a tool drive recess to enable the socket to be rotated in engagement with the threading strips without creating stress producing discontinuities in the socket subjected to hinge pin pressure. The clearance opening formed in each anchor plate is formed with an inwardly swaged boss which provides additional lateral support for the hinge pin sockets in the region absorbing the hinge pin pressure. The hinge pin sockets are formed of a molded hard plastic such as an acetal resin, and the anchor plates of spring steel.

DESCRIPTION OF THE DRAWINGS

FIG. 1 is a front elevational view of a refrigerator cabinet having reversibly mounted doors.

FIG. 4 is a view of section B—B taken in FIG. 1.

FIG. 5 is a view of section C—C taken in FIG. 4 and rotated 90° counterclockwise.

FIG. 9 is a partial front elevational view of an alternate form of anchor plate.

FIG. 10 is a partial end view of the anchor plate shown in FIG. 9.

DETAILED DESCRIPTION

Figure 6:
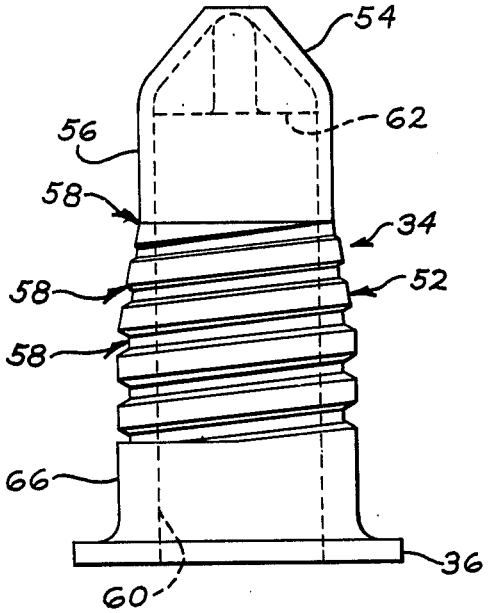
FIG. 6 is a side view of a hinge pin socket according to the present invention.
Figure 7:
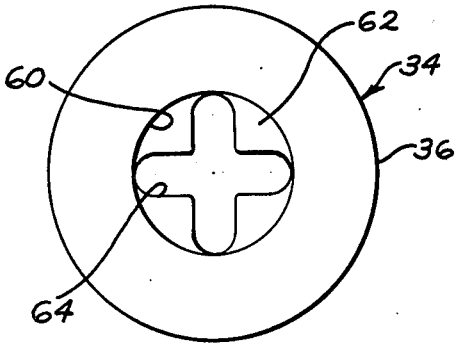
FIG. 7 is an end wise view of the hinge pin socket shown in FIG. 6.
Figure 3:
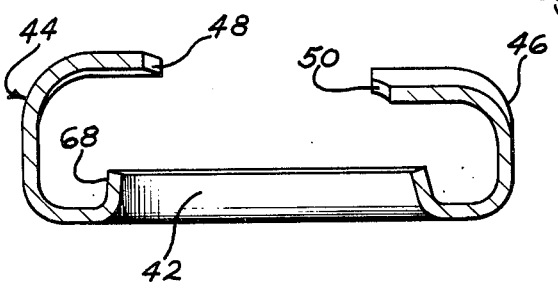
FIG. 3 is an enlarged view of the section A—A taken in FIG. 2 through a portion of the anchor plate.

In the following detailed description, certain specific terminology will be utilized for the sake of clarity and a particular embodiment described in accordance with the requirements of 35 USC 112, but it is to be understood that the same is not intended to be limiting and indeed should not be so construed inasmuch as the invention is capable of taking many forms and variations within the scope of the appended claims.

Referring to the drawings and particularly FIG. 1, there is depicted a refrigerator cabinet 10 to which the mounting arrangement according to the present invention has particular application. Refrigerator cabinets are commonly provided with an upper rectangular door 12 and a lower rectangular door 14 such as to provide access to the freezer and refrigerator storage compartments. It is the usual practice that the doors are provided with hinges 16 which include hinge pins received within bores formed in hinge pin socket assemblies 18 which will be described hereinafter, mounted within the interior of each of the refrigerator doors 12 and 14 so as to provide a pivotal mounting for the doors 12 and 14.

Also secured to the opposite side of the door are the respective door handles 20 and 22 attached to the upper and lower doors 12 and 14, respectively. The door handles 20 and 22 have at least one end, and in the case of the handle 20, both ends, secured to lateral edges which also receive the hinge pin socket assemblies 18.

The concept according to the present invention has particular application to those cabinets in which the installation of the door handles 20 and 22 and the hinges 16 may be reversed. That is, the mounting hardware for the hinges 16 may be switched to the door side to which the door handles 20 and 22 are installed, where the hinges have previously been mounted so as to quickly adapt the door opening direction to different locations requiring such different door opening direction for convenient access.

Accordingly, each corner of the cabinet doors 12 and 14 is provided with a hinge pin socket assembly 18 along opposite sides for receiving the hinge pins on either of opposite sides of the refrigerator doors. Also, each corner must have hardware in each corner to provide for the installation of the door handles 20 and 22, and also a door stop (not shown in FIG. 1) at the lower edge adjacent the hinge 16 of each of the upper and lower doors 12 and 14.

Referring to FIGS. 2 through 5, the installation of the hinge pin socket assembly 18 is depicted and the lower corner of the door 14 is shown to depict a typical installation, it being understood that a similar assembly is provided at each corner, except that the door stops 24 are normally provided only at the bottom corners.

Each installation includes a hinge assembly 16 which is secured to the face of the cabinet 10 immediately below the lower lateral edge 28 of the door 14 as by threaded fasteners 31, such that the hinge pin 26 is in alignment with a clearance opening 30 provided in the lower door edge 28.

The hinge assembly 16 includes a hinge bracket 33 to which is affixed the hinge pin pedestal 32 to thereby mount the hinge pin 26 to the refrigerator cabinet 10. The hinge pin 26 is received within a bore 60 (FIG. 6) of a hinge pin socket 34 included in each hinge pin assembly 18 which is mounted within the clearance opening 30 with an outer flange 36 flush against the lower door edge 28 as shown in FIG. 5, such as to provide a mating bore for the hinge pin 26.

The hinge pin socket 34 is retained within the clearance opening 30 securely by means of a anchor plate element 38 which is pressed into the corner of the lower door 14 flush against the interior surface 40 of the lower door edge 28. The anchor plate 38 is formed with a corresponding clearance opening 42 which is positioned in alignment with a clearance opening 30 such that the hinge pin socket 34 is received through both clearance openings 30 and 42.

The hinge pin socket 34 is secured to the anchor plate 38 by a threaded mount comprised of a pair of threading strips 44, 46 which are formed integrally with the sides at opposite locations on either side of the clearance opening 42 and having inwardly extending terminal portions 48 and 50 which are provided with arcuate contours adapted to be received into threaded engagement with external threads 52 formed on the hinge pin socket 34 intermediate the flange 36 and the end portion 54.

The terminal portions 48 and 50 of the strips are also inclined at an angle such as to correspond to the helix angle of the thread 52 and are offset in accordance with the position of the thread at 180° opposite positions along the thread 52 such as to provide a threaded engagement between the threading strips 44 and 46 and the external thread on the socket element 34. Thus the hinge pin socket 34 is introduced through the clearance openings 30 and 42 with the outer portion 54 having a tapered end and a smaller diameter body section 56 which pilots the hinge pin socket 34 into the openings and guides it into engagement with the threading strips 44 and 46.

The external thread 52 is tapered as best seen in FIG. 6 such that as the hinge pin socket 34 is advanced threadably on the threading strips 44 and 46, the threading strips 44 and 46 are spread apart since their initial or relaxed radial position is such as to just receive the body section 56. As the root 58 of the external thread progressively enlarges along the length of the thread 52, the strips 44 and 46 are deflected outwardly to create an increasing frictional engagement force with the arcuate contours on the end portions 48 and 50 to provide a secure retention on the hinge pin socket 34.

This effect is augmented by a further engagement force which is created upon seating of the flange 36 on the bottom edge 28 of the door panel of the door 14. This seating engagement thereof creates a compression of the threading strips 44 and 46 which tends to produce a further engagement of the arcuate surfaces 48 and 50 with the thread flanks. The arcuate contour is selected so as to be concentric with the full root diameter beyond the taper section, such that full surface contact is achieved.

The net result is a very secure engagement provided without the necessity of applying relatively great driving forces to the hinge pin sockets 34 during installation thereof.

The strength of the installation is further enhanced by means of a swaged boss 68 formed about the clearance opening 42 in the anchor plate 38. The swaged boss 68 provides further support for the outer body section 66 of the hinge pin socket 34 such as to afford maximum support at the point of maximum loading.

This threaded engagement bears some similarities with the so-called "Speed Nuts" sold by Tinnerman Products, Inc. in that strip material engages an external thread. However, the nature of the thread mount here disclosed differs in that the threading strips 44 and 46 are each formed from a side of the anchor plate 38 so as to have a first portion extending upwardly from the anchor plate 38 which is then bent at an angle to form second portions extending radially inward. The intermediate space between the terminal portions 48 and 50 receives the hinge pin socket 34 in threaded engagement therewith.

In the "Speed Nut" construction, the strips are merely bent up from within the confines of a strip of material. This produces differing results in the present context: The frictional engagement forces, while increasing as the hinge pin socket 34 is advanced thereinto, are not increased to the extremes of a speed nut due to the "toggle" geometry of the strips in a speed nut.

The increase in frictional forces in the thread mount according to the present invention are thus much more controlled.

A second difference lies in the configuration of the threading strips 44 and 46, i.e., extending upwardly from the anchor plate 38 sides. This leaves an intermediate sheet into which can be formed the clearance opening 42, which, in conjunction with the threading strips 44 and 46, thus supports the hinge pin sockets 34 against radial loads applied by the hinge pins 26, at spaced points along the hinge pin sockets 34. The position of the threading strips 44 and 46 is adjacent the reentry flange and outer panel for maximum strength.

A third difference is in the relative compactness of the thread mount, which enables it to be fit within the tight confines of the interior of the door, particularly for smaller width doors. This compactness is produced by the bent angle of the portions of the threading strips 44 and 46.

The hinge pin socket 34 is formed with an internal bore 60 which is adapted to slidably receive the hinge pin 26 and accommodate its length, while at its remote end, the internal bore 60 terminates in an end wall 62 in which is formed a tool driving recess 64, which is here shown as accommodating a Phillips screwdriver cross pattern, in a specific embodiment comprising a Phillips No. 2 driver point. This location for the drive surface avoids the weakening which can occur if the bore 60 were formed with a discontinuity in the vicinity of the flange 36, i.e., at the body section 66. This reduction in strength would result from the presence of a discontinuity created stress point tending to cause the hinge pins to split the sidewall of the hinge pin socket 34 under heavy transverse loads impressed on the hinge 16 upon the refrigerator door 14 being opened to the full limit and the resultant abutment of the door stop 24 with the hinge bracket 33.

The door stop 24 is adapted to be installed by means of a relatively large threaded fastener comprised of a sheet metal screw 70 which passes through a clearance opening 72 formed centrally of the door stop 24 through a corresponding clearance opening 74 formed in the lower door edge 28. It is received in an opening formed by a helical impression 76 punched into the anchor plate 38 at a location laterally offset from the clearance bore 42. The door stop 24 also is provided with a pair of hinge pin clearance openings 78 and 80 and recess areas 82 and 84 which provide a recess for receiving the flange 36 such that the surface 86 is in abutment with the door bottom edge 28 and the outer surface of the flange 36.

Two such recesses 84 and 82 and clearance passages 78 and 80 are provided in order to afford reversibility to the door stop 24, i.e., is reinstallation on the opposite side on either door 12 or 14.

Figure 2:
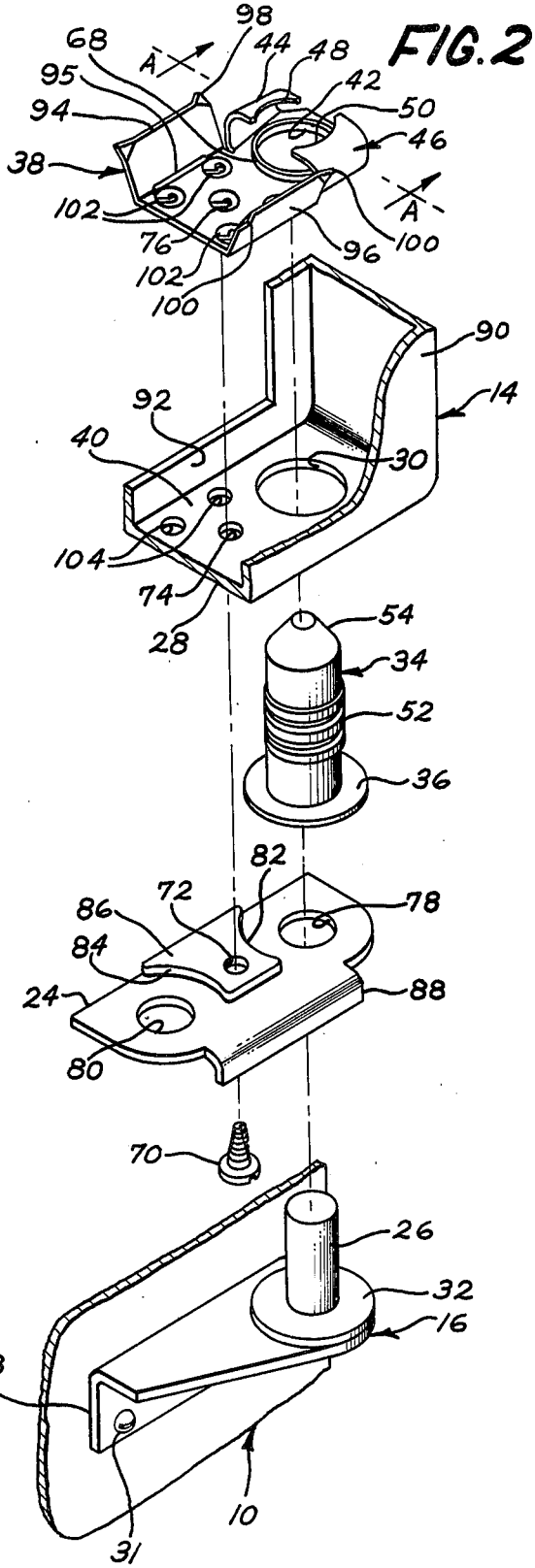
FIG. 2 is an exploded perspective view of the various door hinge hardware components together with a portion of the door corner to which the components are mounted.

Door stop 24 is provided with a stop flange 88 which is bent downwardly as shown in FIG. 2 to be in position to engage a lateral surface of the hinge bracket 33 when the door is opened to a desired limit.

The anchor plate 38 is repositioned within the interior of the door 14 in the position described, that is, within the outer panel 90 and the inner reentrant flange 92, by means of a pair of channel sides 94 and 96, each of which has friction barbs 98 and 100 formed at either corner. The channel sides 94 and 96 are inclined outwardly such that when anchor plate 38 is installed in the door, the channel sides 94 and 96 forced inwardly creating a frictional engagement between the corner friction barbs 98 and 100 until the anchor plate 38 is flush against the interior surface 40 of the door edge 28.

The friction barbs 98 and 100 provide secure retention of the channel 38 within the reentrant flange and the surface of the outer door panel 90 to securely position the same until installation of the sheet metal screws and the hinge pin sockets 34 in each corner.

Each of the channel sides 94 and 96 is slotted at 95 and 97 to render the channel sides 94 and 96 more compliant to bending to render the installation of the anchor plate 38 easier.

It is noted that the thread mount for the hinge pin sockets allows their installation without knocking out the anchor plates 38, since no dislodging force is created.

The anchor plate 38 is provided with additional smaller openings, i.e., helical impressions 102 which are included for the purpose of providing additional mounting holes for the door handle installation, as will be described, and accordingly the door edge 28 is provided with clearance openings 104 positioned in alignment with the helical impressions 102 in every position at which the anchor plates 38 are located. The helical impressions 102 are located on either side of the central larger helical impressions 76 such as to afford reversibility of the anchor plate 38, installation thereof at either side of the doors such that the single anchor plate configuration can be provided to be installed at all four corners of the doors 12 or 14.

This is of course dependent on the symmetry of the openings with respect to the thickness of the doors which is usually the case. In some instances, such symmetry is not present and in this case, an anchor plate 38 configuration may be provided in which a pair of clearance openings 42 and threading strips 44 and 46 are provided at either end of the anchor plate 38, such that the anchor plate 38 can be repositioned in the same orientation with respect to the door edge on either side of the door.

Each anchor plate 38 is formed of spring steel preferably and has suitable springiness for both the threading strips 44 and 46 and the channel sides 94 and 96, when formed of a thickness which will allow the clearance within the flanks of the external threads 52 to allow free threading movement of the contours 48 and 50 within the thickness of the root 58.

In this respect, the thickness of the material can be slightly larger than the thread root while allowing proper frictional force therebetween. It is noted that the hinge pin socket 34 is preferably formed of a hard plastic such as an acetal resin plastic available under the tradename "Delrin" manufactured and sold by DuPont Corporation. This material has suitable strength characteristics for the present application while allowing a relatively easy threading into the threading legs 44 and 46. However, the internal thread configuration must be molded into the hinge pin socket 34 since this plastic is too hard for the threading action to take place upon installation.

It is further noted that the hinge pin sockets 34 which are manufactured by suitable injection molding techniques should preferably be formed with a gate location at the upper end portion 54 such that the flow of plastic within the mold flows axially down the length of the hinge pin socket 34 so as to avoid the formation of a cold seam along the length of the hinge pin socket 34 which may be created by central radial flow injection. It is of course important that the presence of axially extending weaknesses are avoided to the maximum extent possible to insure adequate strength to transverse loading impressed by the hinge pins 26.

Figure 8:
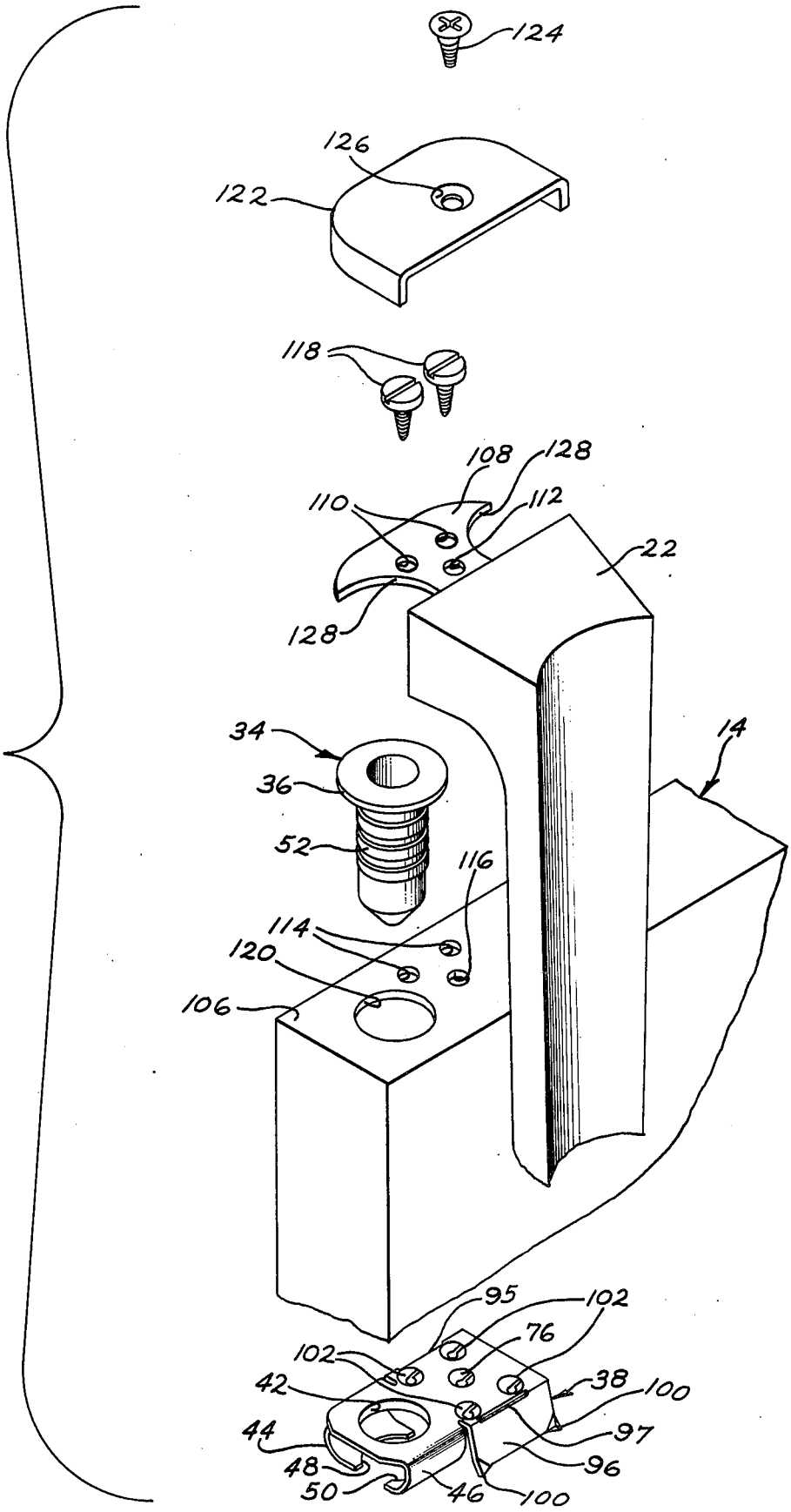
FIG. 8 is an exploded perspective view of the various hardware components to which the door handle is affixed, including a portion of a door handle and the door corner.

Referring to FIG. 8, the installation of the door handle 22 to the upper edge 106 of the door 14 is shown. The door handle 22 is provided with a mounting tongue 108 which is positioned against the upper edge 106 with a hole pattern comprised of two outer holes 110 and a central hole 112. The two outer holes 110 and the central hole 112 are aligned with a similar hole pattern comprised of two outer holes 114 and a central hole 116 formed in the upper door edge 106 such that in positioning the door handle 22 in abutment against the upper edge 106, these holes are in alignment to provide a clearance for a pair of sheet metal screws 118 passing through the respective outer pairs 110 and 114 and being threadably received into two of the helical impressions 102 formed in the anchor plate 38. The anchor plate 38 is pressed into the interior of the door 14 with the clearance opening 42 in alignment with the corresponding clearance opening 120 formed in the upper door edge 106. Two of the helical impressions 102 are thus positioned in alignment with the outer hole pairs 110 and 114 and the central helical impressions 76 in alignment with the central opening 112 and 116, respectively.

Thus, the sheet metal screws 118 pass into threaded engagement with the helical impression 102 to secure the door handle 22 to the anchor plate 38 and thus to the door 14. In addition, a handle cover 122 is provided which covers the tongue 108 and handle screws 118. A counter-sunk screw 124 is passed through an opening 126 formed therein and thence through clearance openings 112 and 116 and into threaded engagement with the central helical impression 76.

Hinge pin socket 34 is provided in each corner of the door and threaded into the threading strips 44 and 46 through the clearance opening 120 in similar fashion to that described above in reference to FIGS. 2 through 5.

The door handle 22 is either offset sufficiently to clear the flange portion 36 or alternatively cutouts 128 may be provided such that the mounting tongue 108 can be seated against the upper edge 106 of the door 14.

An alternate form of the anchor plate 38 is shown in FIGS. 9 and 10. This variation comprises the incorporation of tabs 130 rather than the barbs 98 and 100, with slots 132 formed adjacent thereto to enable accommodation of a greater width variation than the barb design described above. This alternative is preferred where significant variations in door width are to be encountered.

The mounting arrangement according to the present invention thus comprises a plurality of anchor plates 38, one of each of the plurality of anchor plates 38 mounted within a corner of the doors 12 and 14, seated against the interior surface of opposite lateral edges of the doors 12 and 14. The opposite door edges are those into which are mounted the hinge pin sockets 34, which in turn are appropriately located to receive the hinge pins 26 of the various hinge assemblies 16. At either location of the hinge assembly 16, i.e., on either side of the doors 12 and 14, a plurality of hinge pin sockets 34 are provided, one of which is mounted to each of the anchoring plates 38, with the hinge pin sockets 34 extending into the lateral edges of the doors 12 and 14. Each anchor plate 38 is also provided with openings adapted to receive threaded fasteners (sheet metal screws) which are utilized both to mount at least one end of the door handles and also to mount the door stops 24, with the identical locations with respect to the door edges such that the same hole may be utilized for mounting either the door handles or the door stops. Thus, the anchor plates 38 provide a mount for both the door handles, door stops and all of the hinge pin sockets 34 to allow the use of a single hardware item.

Since such hardware item is required for reversible door mounting, i.e., both sides of the door must be supplied with some form of hardware for mounting the door handles and the door stops, the use of a separate anchor plate to mount the hinge pin sockets 34 does not add any additional components over that already required in order to mount the hinge pin sockets 34.

It can thus be appreciated that the objects of the present invention have been provided by the fastener arrangement comprised by the plurality of anchor plates 38 and the externally threaded hinge pin sockets 34 which provide a means for assembling the molded plastic hinge pin sockets 34 into the door edges. This form of installation provides an extremely strong and secure support for the hinge pin sockets 34 since the hinge pin load is transmitted into the spring steel anchor plate 38 which is in turn mounted to the door by means of a large sheet metal screw 70 as well as the engagement with the reentry flange 92 and the outer wall 90 by the channel legs 94 and 96.

The engagement of the arcuate contours on end portions 48 and 50 formed on the threading legs 44 and 46, respectively, provides a tight frictional gripping which resists any tendency to loosen the result of the door openings and closings. This is accomplished while not involving the application of relatively heavy installation forces when installing the hinge pin socket 34 and without exerting any dislodging forces on the frictionally retained anchor plate 38. The anchor plate 38 serves as the mounting hardware for the door handles and also the door stop such that a single common hardware item can be positioned within each corner of the cabinet doors in affording reversibility of the hinge mounting door handles and door stops.

In addition, the mounting of the hinge pin sockets 34 does not involve the obstruction as by welding or swaging of an element or swage contour at the clearance opening within the door panel which would preclude the use of the clearance opening as a drain hole during surface treatment of the formed door panel, since the anchor plate 38 may be emplaced after these treatments have taken place, as the installation of the anchor plates 38 is by being pressed in within each corner of the door to maintain its position prior to installation of the hinge pin sockets 34 and the various other hardware components.

The hinge pin socket 34 is of molded plastic and resists relatively heavy radial splitting pressure since it is supported by the swaged boss 68 and is free from discontinuities in the region where the hinge pins 26 are in engagement, to thus afford maximum resistance to splitting. This is afforded by the location of the drive recess at the terminal end of the socket while allowing the socket to be driven by ordinary tools such as a Phillips screwdriver during installation.

The thread mount created by the threading strips 44 and 46 are formed so as to extend upwardly and radially inwardly to produce a compact structure so as to be able to be located in relatively narrow quarters such as is available within the interior space of the door 14. The nature of the threaded frictional engagement is such as to provide secure retention of the hinge pin sockets 34.

In addition, the clearance openings in the door lateral edges may simply be punched holes with tolerances not critical since they merely provide a clearance for the body of the hinge pin sockets 34. The door edge is not necessarily engaged by the hinge pin sockets 34 since the swaged boss 68 provides securement against hinge pin loadings and, accordingly, this hole as well as the clearance holes for the sheet metal fasteners may simply be punched into the door panel prior to forming to keep manufacturing costs at a minimum.

The embodiments of the invention in which an exclusive property or privilege is claimed are defined as as follows:

1. An arrangement for reversibly mounting a door on a cabinet by means of hinge pins mounted on said cabinet, said door being formed with an outer panel, lateral edges and reentrant flanges creating an interior space, said door further having a door handle with at least one end secured to one of said door edges at at least one of said corners, the arrangement comprising:

a plurality of anchor plates, one of each of said plurality of anchor plates mounted at each corner of said door within said interior space against the inside surface of a lateral edge;

a hinge pin socket mounted in each of said corners of said door, each hinge pin socket having a bore formed therein to slidably receive a hinge pin, each of said hinge pin sockets extending into opposite lateral edges of said door through a clearance opening formed therein;

means mounting each of said hinge pin sockets to a respective one of said plurality of anchor plates;

means securing said at least one end of said door handle to said anchor plate mounted at said at least one of said corners, whereby said at least one end of said door handle and said hinge pin sockets are mounted to said anchor plates;

means detachably mounting said hinge pins to said cabinet along either side of said door aligned with and received within a respective hinge pin socket extending into opposite edges of said door, to thereby pivotally mount said door on said cabinet along either side of said door.

2. The arrangement according to claim 1 wherein said means mounting said at least one end of said door handle includes a threaded fastener, and means threadably receiving said threaded fastener into said anchor plate.

3. The arrangement according to claim 1 wherein said door has a door stop mounted at a corner of said door at which is mounted said hinge pins, said arrangement further including means for mounting said door stop to one of said anchor plates located at said one of said corners.

4. The arrangement according to claim 3 wherein said means for mounting said at least one end of said door handle and said door stop to said anchor plate comprises threaded fasteners adapted to be threadably received within at least one hole formed in said anchor plate, said at least one hole having an identical location on said anchor plate disposed at each of said door corners, whereby the common hole location may be utilized for mounting said at least one end of said door handle and said door stop.

5. The arrangement according to claim 1 wherein said anchor plate is frictionally secured within said interior space by a pair of channel sides formed on said anchor plate and extending away at an inclination therefrom, said channel sides frictionally engaging the interior surface of said outer door panel and reentrant flange on said door to provide said frictional securement.

6. The arrangement according to claim 5 further including a tab formed on each of said channel sides bent outwardly therefrom and engaging said interior surface and further including a slot formed in each of said channel sides adjacent a respective tab to accommodate varying widths of said interior space.

7. The arrangement according to claim 1 wherein said means mounting said hinge pin sockets includes at least one threading element secured to each of said anchor plates in threaded engagement with an external thread formed on each of said hinge pin sockets, and wherein each of said anchor plates is formed with a clearance opening aligned with said clearance openings at each corner in said door edges, each of said hinge pin sockets extending through both of said openings into threaded engagement with said at least one threaded element.

8. The arrangement according to claim 7 wherein said anchor plate clearance opening is formed with an inwardly extending boss portion and wherein each of said hinge pin sockets is formed with a body portion slidably received within said boss portions whereby said boss portions provide additional support for said hinge pin sockets and loads imposed thereon by said hinge pins.

9. The arrangement according to claim 8 wherein said anchor plates are formed of spring steel and wherein each of said hinge pin sockets is formed of a plastic material.

10. The arrangement according to claim 9 wherein each of said hinge pin sockets is molded from an acetal resin plastic and wherein said molding process, said plastic is injected from a direction so as to produce axial flow of said injected plastic with respect to said external thread whereby said resultant hinge pin socket external thread is not formed with an axially extending seam created by flow of said injected plastic radially upon injection.

11. The arrangement according to claim 7 wherein said means mounting said hinge pin sockets comprises a pair of threading strips secured to each of said anchor plates disposed opposite each other about said anchor plate clearance opening, each of said threading strips including a portion extending radially inward into engagement with said external thread on said hinge pin socket mounted to said anchor plate.

12. The arrangement according to claim 11 wherein said threading strips are formed of sheet material of a thickness substantially the thickness of the thread root formed on each of said hinge pin sockets and wherein said threading strips are inclined corresponding to the axial inclination of said external threads formed on said hinge pin sockets.

13. The arrangement according to claim 11 wherein each of said pair of threading strips is located adjacent said outer panel and said reentrant flange of said door.

14. The arrangement according to claim 11 wherein each of said hinge pin sockets is formed with a drive surface engageable by an installation tool for rotating each of said hinge pin sockets into threaded engagement with said threading strips.

15. The arrangement according to claim 14 wherein said drive surface comprises a recess formed within each of said hinge pin sockets at an inward portion of said hinge pin sockets remote from said door lateral edges, said recesses accessible by an installation tool extending into said hinge pin receiving bore formed in each of said hinge pin sockets, wherein said recess is formed on a portion of said bore which is not engaged by said hinge pin, thereby increasing the strength of said hinge pin sockets against splitting pressure exerted by said hinge pins.

16. The arrangement according to claim 11 wherein each of said threading strips is formed with an arcuate contour on a radially innermost portion thereof in engagement with said external thread, said arcuate contour concentric to the thread root diameter of said external thread on said hinge pin sockets.

17. The arrangement according to claim 16 wherein each of said threading strips includes a first portion extending upwardly from said anchoring plate and a second portion formed at an angle to said first portion and extending radially inward, each of said second portion ends formed with said arcuate contour.

18. The arrangement according to claim 17 wherein each of said hinge pin sockets is formed with said external thread root diameter tapering along the length of said hinge pin sockets and wherein said threading strips extend radially inward sufficient to engage the smallest diameter of said thread root whereby as said hinge pin socket is advanced into said threaded engagement, said thread root causes movement of said second portion radially outward as said external thread root diameter increases, whereby frictional engagement forces increase between said arcuate contour ends of said second portions and said threaded root diameter of said external threads.

19. The arrangement according to claim 18 wherein said hinge pin sockets are formed with a flange portion at the outer end thereof adapted to be seated on said door lateral edges about said clearance openings, whereby upon advancement of said hinge pin sockets into threaded engagement with said threading strips, said seating of said flanges on said door edges produces axial compression of said second portion of said threading strips thereby increasing the frictional engagement force therebetween.

20. In a cabinet having at least one door mounted by means of hinge pins secured to said cabinet and extending into hinge pin sockets mounted to opposite edges of said door, said door being formed so as to have an interior space, an arrangement for mounting said hinge pin sockets within said interior space of said door at locations corresponding to said hinge pins comprising:

a plurality of anchor plates, one of said plurality of anchor plates mounted within said door adjacent said opposide edges at each location whereat said hinge pin sockets are located;

a clearance opening formed in said opposite edges of said door through which said hinge pin sockets extend;

a corresponding clearance opening in each of said anchor plates aligned with said door clearance openings receiving said hinge pin sockets;

means producing a threaded engagement between said anchor plate and each of said hinge pin sockets, whereby said hinge pin sockets are mounted to said door by means of said anchor plates.

21. The arrangement according to claim 20 wherein each of said anchor plate clearance openings is formed with an inwardly extending boss portion and wherein each of said hinge pin sockets is formed with a body portion slidably received within said boss portion whereby said boss portion provides additional support for said hinge pin sockets and loads imposed thereon by said hinge pins.

22. The arrangement according to claim 20 wherein said threading strips are formed of sheet material of a thickness substantially the thickness of the external thread root formed on each of said hinge pin sockets and whereby said threading strips are inclined correspondingly to the inclination of said external threads formed on said hinge pin sockets.

23. The arrangement according to claim 20 wherein said means creating a threaded engagement comprises a pair of threading strips secured to each of said anchor plates disposed opposite each other about said clearance opening, each of said threading strips extending radially inward into engagement with an external thread formed on each of said hinge pin sockets.

24. The arrangement according to claim 23 wherein each of said threading strips is formed with an arcuate contour on the radially innermost portion thereof, said arcuate contour concentric to the thread root diameter of said external thread on said hinge pin sockets.

25. The arrangement according to claim 23 wherein each of said threading strips includes a first portion extending upwardly from said anchoring plate and a second portion formed at an angle to said first portion and extending radially inward, each of said second portion ends formed with said arcuate contour.

26. The arrangement according to claim 25 wherein each of said hinge pin sockets is formed with said external thread root tapering along the length of said hinge pin sockets and wherein said threading strips extend radially inward a distance sufficient to engage the smallest diameter of said thread root whereby as said hinge pin socket is advanced into said threaded engagement, said root portions allow radial movement outwardly of said second portion as said external thread root diameter increases upon advancement thereof of said hinge pin socket, whereby the frictional engagement forces increase between said arcuate contour and said threaded root diameter of said external thread.

27. The arrangement according to claim 26 wherein said hinge pin sockets are formed with a flange portion at the outer end thereof adapted to be seated on said door edges about said clearance openings, whereby upon advancement of said hinge pin sockets into threaded engagement with said threading strips, said seating of said flanges on said door edges produces axial compression of said second portion of said threading strips thereby increasing the frictional engagement force therebetween.

28. The arrangement according to claim 20 wherein each of said hinge pin sockets is formed with a drive surface engageable by an installation tool for rotating each of said hinge pin sockets into threaded engagement with said threading strips.

29. The arrangement according to claim 28 wherein said drive surface comprises a recess formed within each of said hinge pin sockets at an inward portion of said hinge pin sockets remote from said door edges, said recesses accessible by an installation tool extending into said hinge pin receiving bore formed in each of said hinge pin sockets, wherein said recess is formed on a portion of said bore which is not engaged by said hinge pin, thereby increasing the strength of said hinge pin sockets against splitting pressure exerted by said hinge pins.

* * * * *